US008001627B2

(12) United States Patent
Johndro

(10) Patent No.: US 8,001,627 B2
(45) Date of Patent: Aug. 23, 2011

(54) PORTABLE MAIN DRAIN FOR A POOL OF WATER

(76) Inventor: James J. Johndro, Loxahatchee, FL (US)

( * ) Notice: Subject to any disclaimer, the term of this patent is extended or adjusted under 35 U.S.C. 154(b) by 898 days.

(21) Appl. No.: 12/006,949

(22) Filed: Jan. 8, 2008

(65) Prior Publication Data

US 2009/0172874 A1 Jul. 9, 2009

(51) Int. Cl.
*E04H 4/14* (2006.01)

(52) U.S. Cl. ..... 4/507

(58) Field of Classification Search ..... 4/507, 509, 4/510, 512; 210/167.1, 163, 244, 167.15, 210/167.16
See application file for complete search history.

(56) References Cited

U.S. PATENT DOCUMENTS

| | | | | |
|---|---|---|---|---|
| 2,975,791 | A | 3/1961 | Pansini | |
| 3,036,712 | A | 5/1962 | Barbara | |
| 3,378,858 | A * | 4/1968 | Jacuzzi | 210/163 |
| 3,433,237 | A | 3/1969 | Gelinas | |
| 3,667,611 | A | 6/1972 | Pansini | |
| 3,782,552 | A * | 1/1974 | Wendell | 210/242.1 |
| 3,932,281 | A * | 1/1976 | Pansini | 210/163 |
| 4,154,679 | A | 5/1979 | Farage | |
| 4,346,484 | A | 8/1982 | Martin | |
| 4,503,573 | A | 3/1985 | Handzel | |
| 4,683,599 | A | 8/1987 | Rief | |
| 4,834,138 | A * | 5/1989 | Dellasso | 137/590 |
| 5,255,398 | A | 10/1993 | Flynn et al. | |
| 5,734,999 | A * | 4/1998 | Nicholas | 4/507 |
| 6,314,590 | B1 | 11/2001 | Lee | |
| 6,397,408 | B1 * | 6/2002 | Veloskey et al. | 4/504 |
| 6,442,774 | B2 | 9/2002 | Wilson et al. | |
| 6,588,029 | B2 * | 7/2003 | Mullings | 4/507 |
| 6,615,417 | B1 | 9/2003 | Newhard | |
| 6,945,267 | B1 * | 9/2005 | Tedona | 137/14 |

* cited by examiner

*Primary Examiner* — David Purol
(74) *Attorney, Agent, or Firm* — Clifford A. Poff; Suzanne Kikel

(57) ABSTRACT

A portable main drain utilizing top and bottom walls with an attached flexible conduit for the removal of debris from bodies of water, ponds or spas, which operates with suction at the cleaner suction port and/or the skimmer from the circulation pump. The bottom wall has four cork feet to support the portable main drain. A flow regulator is positioned where the flexible conduit connects to the suction port. The top wall contains an internal annular wall projecting downwardly to form a flow-regulating gap with the bottom wall to thereby divide the water flow at about 30% from the ports in the bottom wall into a manifold that is supplied with the remaining portion of water by the ports in the top wall.

11 Claims, 4 Drawing Sheets

PORTABLE MAIN DRAIN FOR A POOL OF WATER

CROSS-REFERENCE TO RELATED APPLICATIONS

Not applicable

BACKGROUND OF THE INVENTION

The present invention relates to a mobile fixture for strategical placement to periodical filter withdraw water with entrained impurity including debris from the bottom of a pool of water such as a water garden, fish pond, spa or a swimming pool.

A water garden, fishpond, spa or a swimming pool belong to a class of an artificially created body of water requiring systematic cleaning of debris and contaminants from the body of water. Water skimmers and hand held nets are commonly used to remove debris from the surface of the body of water but drain fixtures are needed to treat the contaminants on or near the floor of the body of water. A need exits for a portable main drain for a body of water to withdraw water both from the surface of the pool floor and from an area near and surrounding the water withdraw site at the pool floor and thereby effectively withdraw entrained impurity including debris from the bottom of the body of water.

Accordingly, it is an object of the present invention to provide a portable main drain embodying a construction and arrangement of parts for withdrawing water by each of a top wall and the bottom wall having water intake ports all communicating with the water manifold communicating with a suction line connected to a pump and a filter via a skimmer or wall mounted suction port with a spring loaded, self-closing flapper, which is a safety feature.

It is a further object of the present invention to provide a portable main drain having a water manifold communicating through a metering wall with intake ports in a bottom wall for restricting water flow to the manifold to a volume less than the volume supplied by intake ports in a top wall for imparting stability to the portable drain and avoiding entrapment with the material of the floor for the body of water.

It is another object of the present invention to provide a portable main drain having spacer support feet members to allow ease of placement repeatedly at diverse sites about the floor of a pool of water without damage to the floor wall material such as plastic or rubber liner material for the body of water.

It is another object of the present invention to provide a portable main drain to serve the function of a permanent main drain when failures occur to the drain and/or associated under ground conduit.

SUMMARY OF THE INVENTION

More particularly, according to the present invention there is provided a portable main drain for a body of water bounded by a sidewall and floor wall. The portable main drain includes a top wall interconnected with a bottom wall by a spacer wall enveloping a volume defining a water manifold. The spacer wall contains a water delivery port and each of the top wall and the bottom wall has water intake ports all communicating with the water manifold. The water intake ports in the bottom wall are dimensioned and arranged to conduct water at a sufficient flow rate for extracting debris from an area of the floor wall surrounding the bottom wall. Stand off members project from the bottom wall for spacing the water intake ports in the bottom wall above the floor wall of the body of water to impart stability to avoid entrapment of the water intake ports with the floor wall of the pool of water. A conduit joined with the outlet port conducts water of the pool of water from the water manifold for delivery externally to the sidewall.

Preferably, the metering wall extends from the top wall to form a water flow control gap with the bottom wall for establishing a reduced and sufficient flow rate of water to the water manifold for extracting debris from the floor wall of the body of water. The metering wall traverses the spacer wall for forming an internal peripheral boundary to the water manifold, such that the meter wall forms an annular water flow space of not more than 30% of the water flow space defined by the water intake ports in the top wall. Preferably, there is a control to regulate water flow from the water manifold by the conduit.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
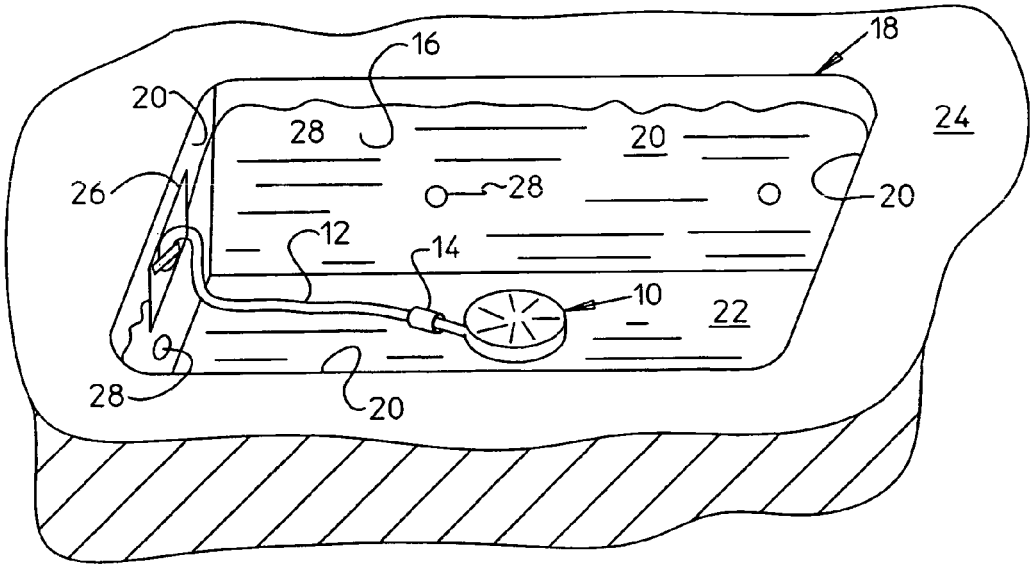
FIG. 1 is an isometric illustration of an in ground swimming pool installation suitable for using a portable main drain according to the present invention.
Figure 2:
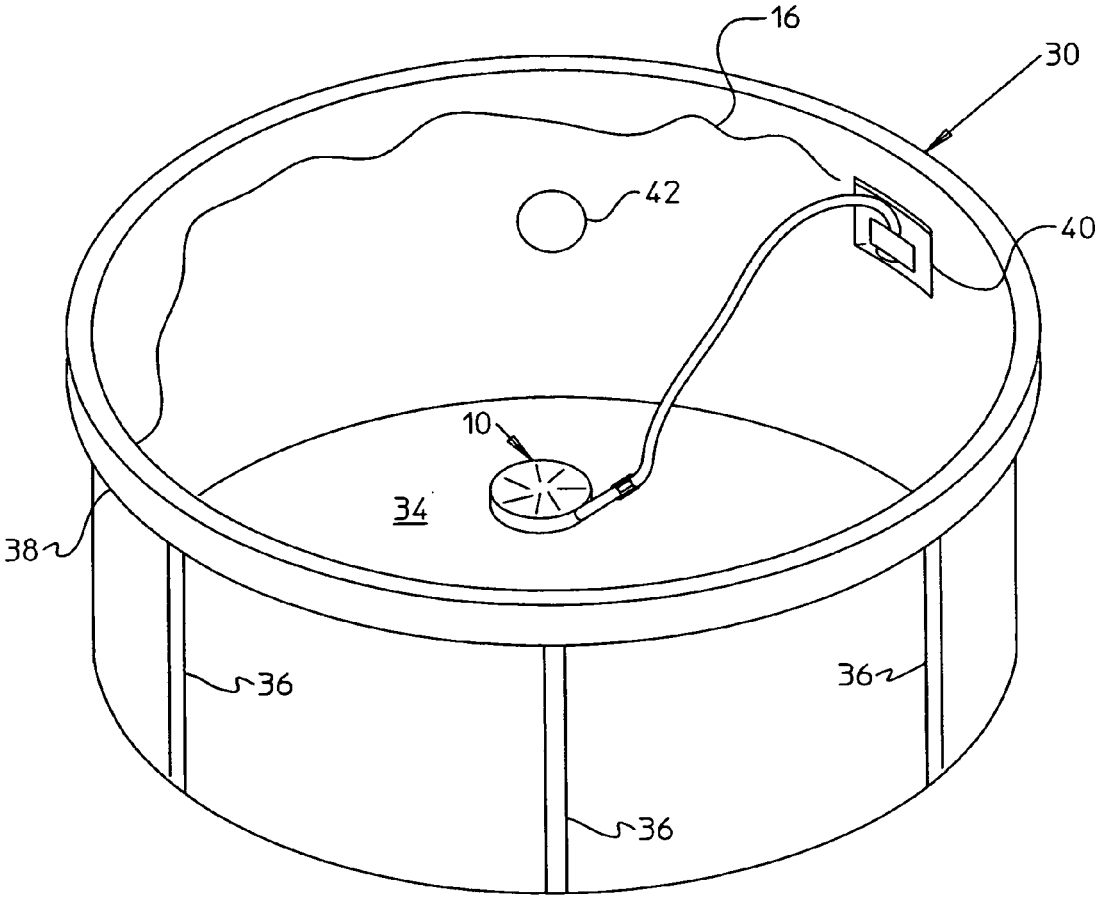
FIG. 2 is an isometric illustration of an above ground swimming pool installation suitable for using a portable main drain embodying the features of the present invention.
Figure 3:
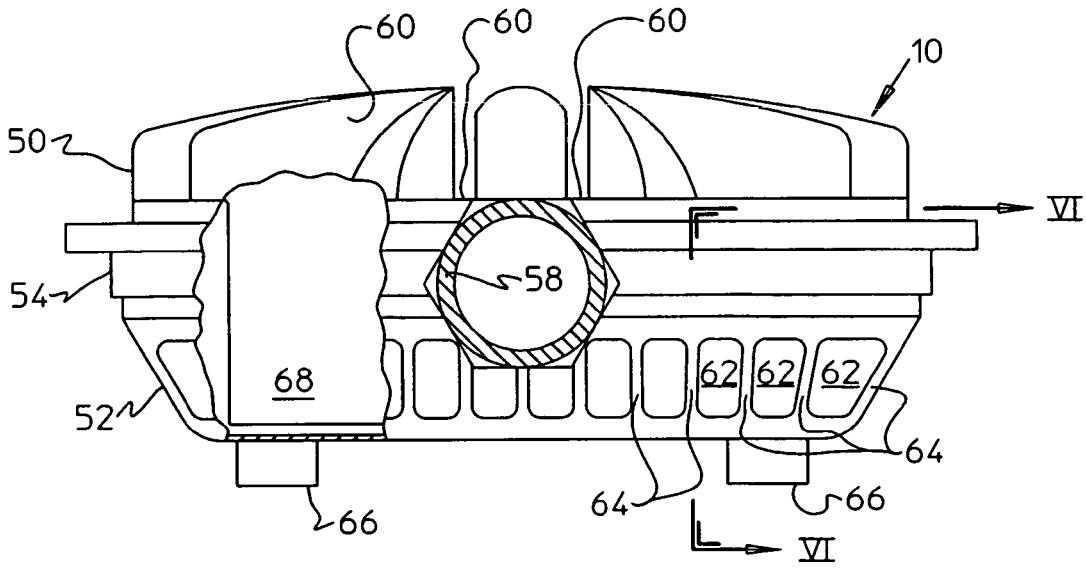
FIG. 3 is a side elevation view, partly in section, of a portable main drain according to the present invention.
Figure 4:
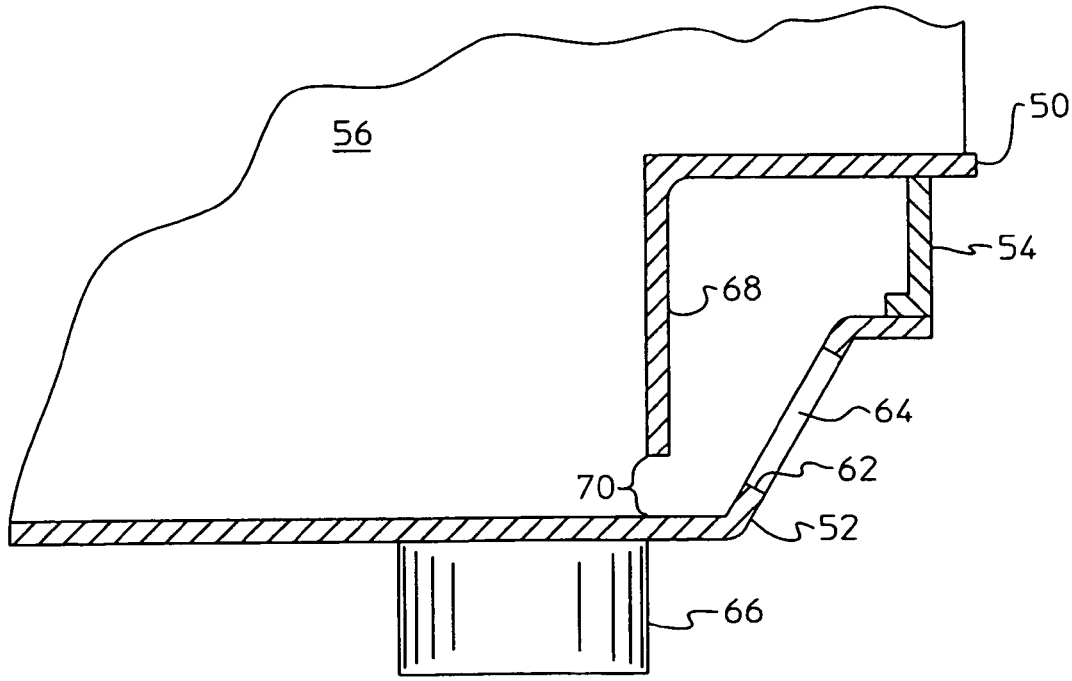
FIG. 4 is a sectional view taken along lines VI-VI of FIG. 3.
Figure 5:
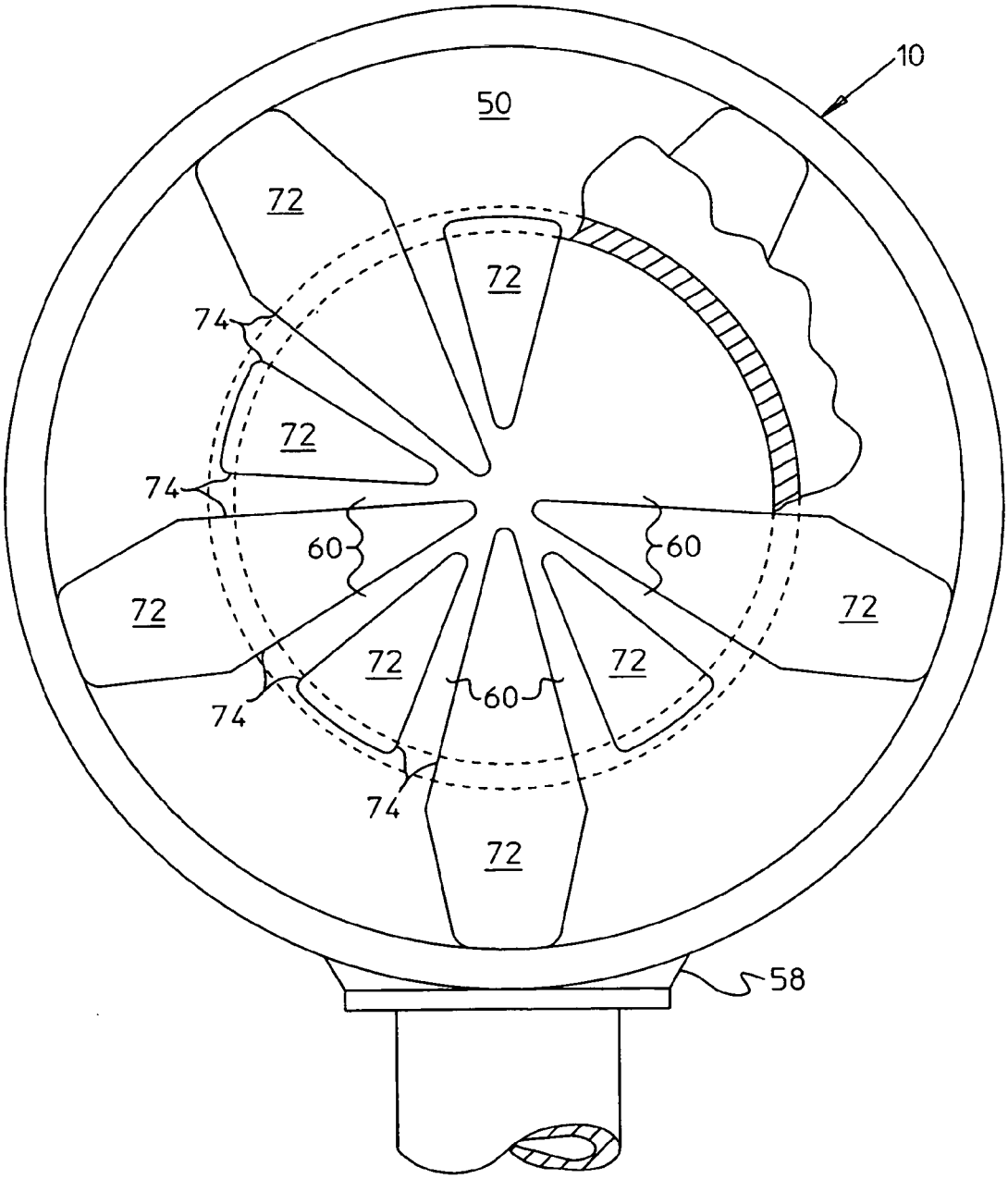
FIG. 5 is a plan view, partly in section, of the portable main drain shown in FIG. 3.

The portable main drain 10 of the present invention is useful for operating in the body of water comprised of any one of an in ground pool of water or an above ground body of water such as a water garden, a fish pond, a spa, or a swimming pool, all of which have a body of water bounded by a sidewall or a water fountain feature and a pool wall. As shown in FIGS. 1 and 2, the portable main drain 10 is connected to a conduit 12; preferably, a flexible hose made of plastic material and constructed in a manner, per se, well known in the art. A sleeve 14 of dense plastic forms a weight passed along the conduit 12 to a site proximate the portable drain to artificially decrease the buoyancy of the conduit when needed to hold down the portable water drain 10 of the present invention in the body of water 16. However, the sleeve 14 is an option because the conduit 12 can embody a construction with a wall of sufficient density to cause the conduit 12 and the adjoined water drain 10 to sink in the body of water without the addition of the sleeve 14.

The illustration in FIG. 1 is typical of an in ground swimming pool 18 as well as a fish pond/water garden bounded by sidewalls 20 and floor wall 22. In a swimming pool, the sidewalls 20 abut with the usual decking 24 and each sidewall contains one or more wall skimmers 26 and usually a cleaner suction port connected to a pump in a circuit with a filter, forming part of the well-known water filtration system, not shown. The filtration system applies suction to a conduit located inside the skimmer housing or the suction is applied to a wall suction port to extract floating debris with water withdraw at the surface of the pool of water. The filtration system usually includes a drain fixture, not shown, permanently installed in the floor wall 22 to withdraw pool water and submerged debris. The filtration system returns the filtered pool water through conduit lines connected to fillings 28 at spaced locations in the sidewall 20 of the body of water 18. The portable water drain 10 of the present invention is particularly usefully to as a temporary or as a permanent replacement for the drain fixture permanently installed in the floor under concrete or a liner. A need for an alternative to a main drain occurs when the drain fixture or associated underground conduit is broken and cannot be repaired. Other circumstances give rise to the usefulness of the portable main drain include the use in a below ground body of water where the conduit and/or the drain fixture erode or otherwise become nonfunctional and as an alternative to replacement of the floor drainage system.

The illustration in FIG. 2 is typical of an above ground swimming body of water 30 as well as a spa. The body of water 30 is bounded by sidewall 32 and floor wall 34. The outer periphery of the sidewall 32 is usually reinforced by vertical bars 36 joined with a rail 38 forming the upper periphery of the body of water. The sidewall larger pools, usually a water depth of 4 feet or greater, contains one or more wall skimmers 40 connected to a pump in a circuit with a filter, forming part of the well known water filtration system, not shown. The filtration system applies suction to a conduit connected to each skimmer to extract floating debris with water withdraw at the surface of the pool water. The filtration system usually includes a water return port 42 permanently installed in the sidewall. An important feature and advantage of the portable main drain 10 arises out of the construction of the drain to operate on the floor of a body of water without sacrificing the integrity of the floor wall, particularly in bodies of water where a liner, usually of plastic or rubber material is use to provide a water impermeable barrier.

As shown in FIGS. 3-6, the preferred embodiment of the portable main drain 10 includes a top wall 50 interconnected with a bottom wall 52 by a spacer wall 54 enveloping a volume defining a water manifold 56. The spacer wall 54 contains a water delivery port 58. The top wall 50 has water intake ports 60 and the bottom wall 52 has water intake ports 62. These intake ports are constructed in the form of non-hair snare anti-entrapment in the top wall and the bottom wall is an anti-entrapment cover. However, the anti-entrapment safety feature is unnecessary with respect to avoiding possible injury to persons or animals using the body of water since the portable main drain is not secured to the structure containing the body of water. All the water intake ports 60 and 62 communicate with the water manifold 56. The bottom wall takes the form of a shallow bowl that includes a truncated conical bottom wall section containing apertures defining the water intake ports 62 each separated by rails 64.

The water intake ports 62 in the bottom wall are dimensioned and arranged to conduct water at a sufficient flow rate for extracting debris from an area of the floor wall surrounding the bottom wall. Stand off members 66 preferably four feet made of cork material are provided with rod-shaped protrusions that are pressed in place and dimensioned to tightly fit in drilled opening in the bottom of the housing. The remaining thickness of the stand off members 66 forms projects from the bottom wall for spacing the water intake ports in the bottom wall above the floor wall of the body of water to impart stability to avoid entrapment of the water intake ports with the floor wall of the pool of water. A metering wall 68 extends from the top wall 50 to form a water flow control gap 70 with the bottom wall for establishing a reduced and sufficient flow rate of water to the water manifold 56 for extracting debris from the floor wall of the body of water. The metering wall extends from the top wall 50 and traverses the spacer wall 54 for forming a cylindrical outer peripheral boundary of the water manifold 56. The water flow control gap 70 formed by the metering wall 68 forms an annular water flow space of not more than 30% of the water flow space defined by the aggregate of the water intake ports 60 in the top wall 50. The top wall contains radial segments 72 separated by rectangular gaps 74 defining the water intake ports 60.

Figure 6:
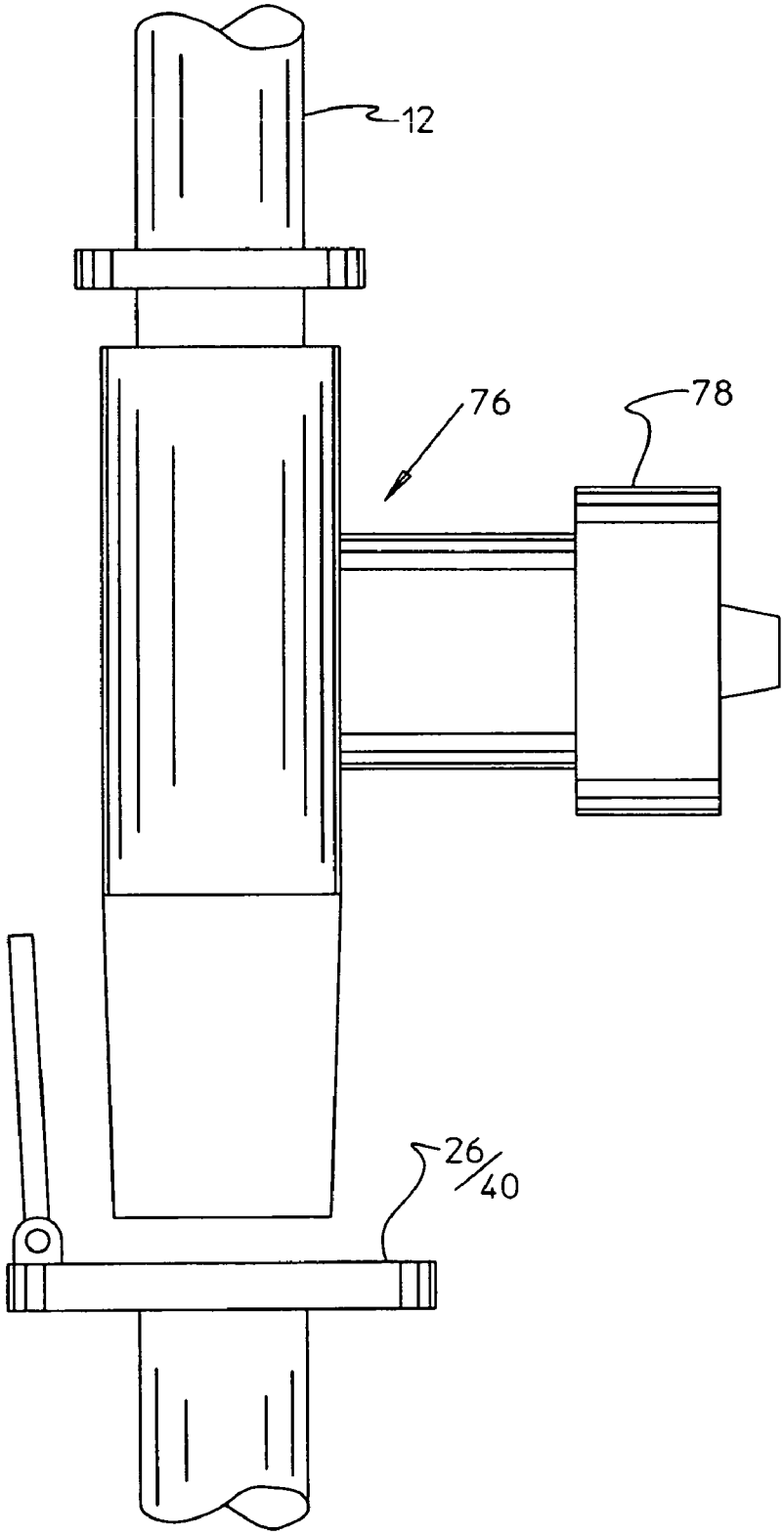
FIG. 6 is an enlarged partial view of a flow regulator for controlling operation of the portable main drain shown in FIGS. 1-5.

The conduit 12 is joined with the outlet port 58 for conducting water of the pool of water from the water manifold 56 for delivery externally to the sidewall of the body of water, spa, fish pond or water garden. In FIG. 6 there is illustrated a control 76 per se well known it the art to regulate water flow from the water manifold by the conduit. The control 76 includes an internal valve adjustable by a sleeve 78 for adjusting the amount of suction applied to the conduit. However, the proportional division of water flow supplied by the intake ports in the bottom wall with respect to the intake portion of the top wall is essentially unaffected by the magnitude of suction.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

The invention claimed is:

1. A portable main drain for a body of water bounded by a sidewall and floor wall, said portable main drain including:

a top wall interconnected with a bottom wall by a spacer wall enveloping a volume defining a water manifold; said spacer wall containing a water delivery port and each of said top wall and said bottom wall having water intake ports all communicating with said water manifold; said water intake ports in said bottom wall being dimensioned and arranged to conduct water at a sufficient flow rate for extracting debris from an area of said floor wall surrounding said bottom wall;

stand off members projecting from said bottom wall for spacing said water intake ports in said bottom wall above said floor wall of said body of water to impart stability to avoid entrapment of said water intake ports with said floor wall of said body of water; and a conduit joined with an outlet port for conducting water of the body of water from said water manifold for delivery externally to said sidewall.

2. The portable main drain according to claim 1 further including a metering wall extending from said top wall to form a water flow control gap with said bottom wall for establishing a reduced and sufficient flow rate of water to said water manifold for extracting debris from said floor wall of said body of water.

3. The portable main drain according to claim 2 wherein said metering wall traverses said spacer wall for forming an internal peripheral boundary to said water manifold.

4. The portable main drain according to claim 2 wherein said metering wall extends from said top wall along said spacer wall for forming a cylindrical outer peripheral boundary of said water manifold.

5. The portable main drain according to claim 4 wherein said metering wall forms an annular water flow space of not more than 30% of the water flow space defined by said water intake ports in said top wall.

6. The portable main drain according to claim 1 further including a control to regulate water flow from said water manifold by said conduit.

7. The portable main drain according to claim 1 wherein said top wall contains radial segments separated by rectangular gaps defining said water intake ports.

8. The portable main drain according to claim 1 wherein said bottom wall contains a truncated conical bottom wall section containing apertures separated by rails defining said water intake ports.

9. The portable main drain according to claim 1 further including a weight attached to said conduit to hold down said water manifold.

10. The portable main drain according to claim 1 wherein said conduit comprises a flexible hose.

11. The portable main drain according to claim 1 wherein said conduit has sufficient density to sink in said body of water.

* * * * *